US008637795B2

(12) United States Patent
Giri et al.

(10) Patent No.: US 8,637,795 B2
(45) Date of Patent: Jan. 28, 2014

(54) SELF-CONFIGURING FLEXIBLE HEATER

(75) Inventors: Abhik Giri, Bangalore (IN); Girish Krishnaiah, Bangalore (IN)

(73) Assignee: Honeywell International, Inc., Morristown, NJ (US)

( * ) Notice: Subject to any disclaimer, the term of this patent is extended or adjusted under 35 U.S.C. 154(b) by 503 days.

(21) Appl. No.: 13/021,301

(22) Filed: Feb. 4, 2011

(65) Prior Publication Data

US 2012/0199575 A1 Aug. 9, 2012

(51) Int. Cl.
*H05B 3/34* (2006.01)

(52) U.S. Cl.
USPC ..... 219/490; 219/483; 219/549; 219/507; 219/519

(58) Field of Classification Search
CPC ..... H05B 1/02; H05B 3/34; H05B 1/294
USPC ..... 219/494, 497, 505, 507–509, 543, 549, 219/216, 490; 399/333, 69
See application file for complete search history.

(56) References Cited

U.S. PATENT DOCUMENTS 6,233,397 B1 * 5/2001 Offir ..... 392/373
6,713,728 B1 * 3/2004 Justice et al. ..... 219/469
7,193,180 B2 * 3/2007 Cook et al. ..... 219/216
7,459,658 B2 12/2008 Hays et al.
2004/0178190 A1 9/2004 Bivens et al.
2005/0067404 A1 3/2005 DeAngelis et al.

OTHER PUBLICATIONS

"Precision, High Side Current Sense Amplifiers," Linear Technology, LT1787/LT1787HV, 16 pages, downloaded from http://cds.linear.com/docs/Datasheet/1787fc.pdf on Feb. 4, 2011.

* cited by examiner

*Primary Examiner* — Mark Paschall
(74) *Attorney, Agent, or Firm* — Craige Thompson; Thompson Patent Law Offices

(57) ABSTRACT

In general, this disclosure describes example techniques for a flexible heater system to automatically configure itself to operate over different input supply voltages. The flexible heater system may include a flexible heater that includes a first heater element and a second heater element. The flexible heater system may also include a switch circuit that may automatically couple the first heater element and the second heater element in a first configuration when an input supply voltage is at a first voltage level. The switch circuit may also automatically couple the first heater element and the second heater element in a second configuration when the input supply voltage is at a second voltage level.

6 Claims, 10 Drawing Sheets

SELF-CONFIGURING FLEXIBLE HEATER

TECHNICAL FIELD

This disclosure relates to flexible heaters, and, more particularly, to flexible heaters that operate over different input supply voltages.

BACKGROUND

A flexible heater may include one or more heater elements formed on a flexible surface. The heater elements may be etched onto the flexible surface, and may include resistive elements. The heater elements may also be silicon rubber heater elements vulcanized to a sheet metal plate. When a voltage is applied to the heater elements, current flows through the heater elements. The current flowing through the heater elements causes the heater elements to dissipate power, which in turn causes the flexible heater to emanate heat.

SUMMARY

In general, this disclosure describes examples of a flexible heater system that automatically configures a flexible heater to operate with different input supply voltages. The flexible heater system may include a switch circuit and the flexible heater. In some examples, the switch circuit may automatically couple heater elements that include one or more resistive elements on the flexible heater in series or in parallel with one another based on the input supply voltage level. In alternate examples, the switch circuit may automatically couple a selected few of the resistive elements of the heater elements to an input supply voltage based on the input supply voltage level.

In one example, this disclosure describes a flexible heater system comprising a flexible heater that includes a first heater element that includes one or more resistive elements and a second heater element that includes one or more resistive elements. The flexible heater system also includes at least one switch that is coupled in parallel to at least one of the one or more resistive elements of the first heater element such that when the at least one switch is turned on substantially no current can flow through the at least one of the one or more resistive elements of the first heater element, and such that when the at least one switch is turned off current can flow through the at least one of the one or more resistive elements of the first heater element. The flexible heater system also includes a switch circuit configured to automatically turn on or off the at least one switch based on whether an input supply voltage is at a first voltage level or second voltage level so that a power dissipated by the first heater element and the second heater element is substantially similar when the input supply voltage is at the first voltage level or the second voltage level.

In another example, this disclosure describes a flexible heater system comprising a flexible heater that includes a first heater element that includes one or more resistive elements and a second heater element that includes one or more resistive elements. The flexible heater system also includes a switch circuit configured to automatically couple the one or more resistive elements of the first heater element and the one or more resistive elements of the second heater element in a first configuration when an input supply voltage is at a first voltage level, and automatically couple the one or more resistive elements of the first heater element and the one or more resistive elements of the second heater element in a second configuration when the input supply voltage is at a second voltage level.

In another example, this disclosure describes a method comprising receiving, with a switch circuit, an input supply voltage. The method also includes automatically coupling, with the switch circuit, one or more resistive elements of a first heater element formed on a flexible heater and one or more resistive elements of a second heater element formed on the flexible heater in a first configuration when the input supply voltage is at a first voltage level. The method also includes automatically coupling, with the switch circuit, the one or more resistive elements of the first heater element formed on the flexible heater and the one or more resistive elements of the second heater element formed on the flexible heater in a second configuration when the input supply voltage is at a second voltage level.

In another example, this disclosure describes a switch circuit configured to receive an input supply voltage, automatically couple one or more resistive elements of a first heater element formed on a flexible heater and one or more resistive elements of a second heater element formed on the flexible heater in a first configuration when the input supply voltage is at a first voltage level, and automatically couple the one or more resistive elements of the first heater element formed on the flexible heater and the one or more resistive elements of the second heater element formed on the flexible heater in a second configuration when the input supply voltage is at a second voltage level.

The details of one or more aspects of the disclosure are set forth in the accompanying drawings and the description below. Other features, objects, and advantages of the disclosure will be apparent from the description and drawings, and from the claims.

DETAILED DESCRIPTION

Figure 1:
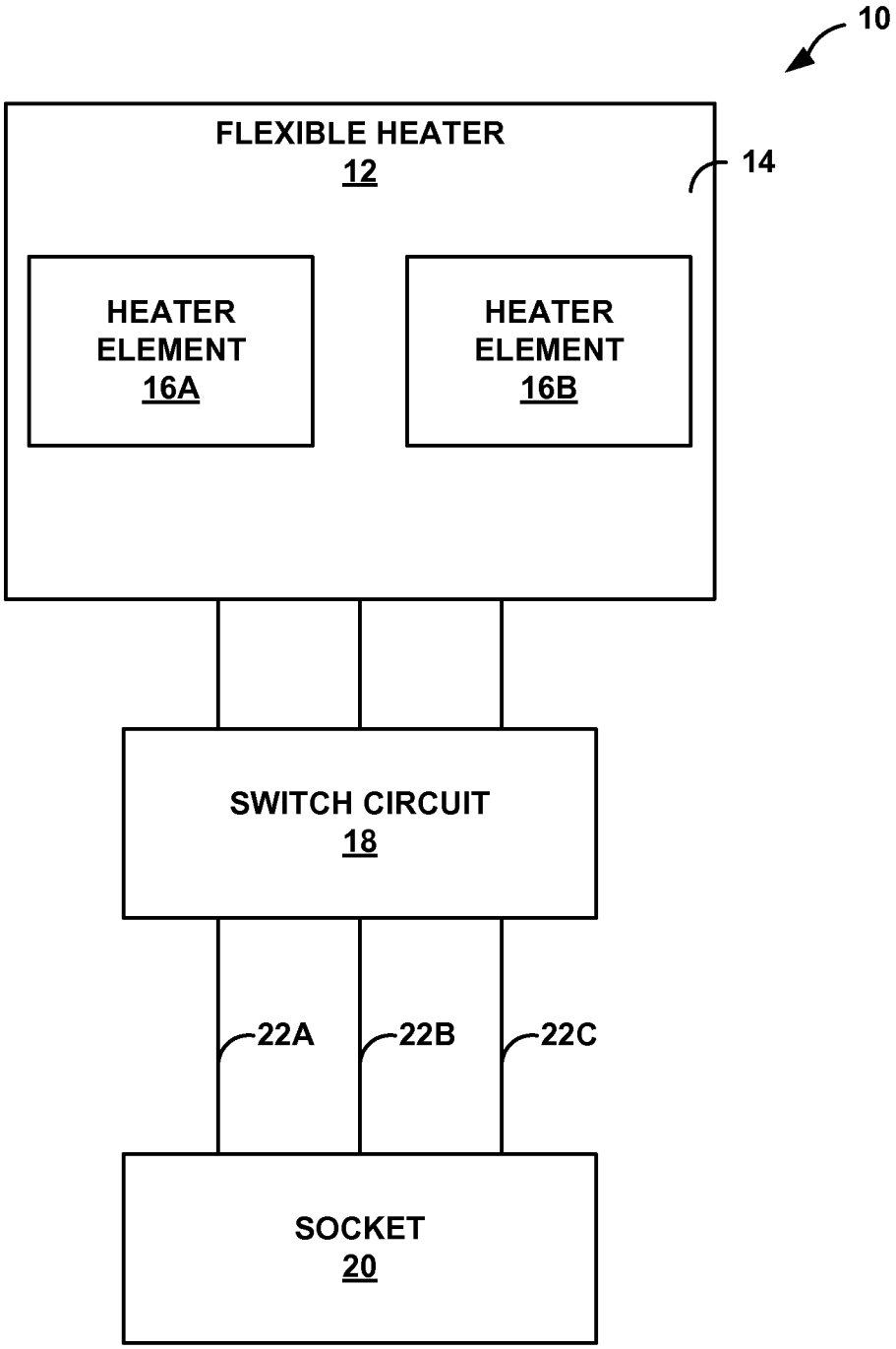
FIG. 1 is a block diagram illustrating an example flexible heater system.

A flexible heater includes heater elements formed on a flexible surface of the flexible heater. For instance, the flexible surface may include polyimide, silicone rubber, Mica, a foil, or other flexible surfaces. The heater elements may include one or more resistive elements. As an illustrative example, the resistance of the resistive elements may be approximately 100 ohms (Ω), although the resistance of the resistive elements could also have other values. Moreover, the resistance of each of the resistive elements need not be the same in every implementation. The heater elements that include the resistive elements, may be etched onto the flexible surface, in a serpentine fashion, to form the heater elements on the flexible surface, as one example. In some examples, the flexible heater may include another flexible surface formed on top of the heater elements to protect the heater elements from damage.

When a voltage (V) is applied to the flexible heater, the voltage causes a current (I) to flow through the resistive elements of the heater elements. The amount of current that flows through the resistive elements can be calculated by dividing the applied voltage with the resistance of the resistive elements (R), e.g., I=V/R. The flow of current through the resistive elements causes power to dissipate along the heater elements, which in turn causes the heater elements to heat. The flexible heater emanates the heat generated by the heater elements.

The power dissipated by the heater elements (P) can be calculated by multiplying the voltage applied to the flexible heater with the current that flows through the resistive elements of the heater elements, e.g., P=V*I. When I is substituted with V/R, V*I reduces to $V^2/R$. In other words, the power dissipated by the heater elements may be calculated as $V^2/R$.

The power dissipated by the heater elements may be different for different applied voltages because the power dissipated by the heater elements is based on the applied voltage. For example, the power dissipated by the heater elements, when the applied voltage is 220 volts alternating current, i.e., 220V AC, may be approximately four times the amount of power dissipated by the heater elements when the applied voltage is 110V AC.

This disclosure describes a switch circuit that automatically configures the coupling of the resistive elements of the heater elements based on the input supply voltage. The phrase "automatically configure" or "automatically couple" means that the switch circuit dynamically configures the manner in which the resistive elements of the heater elements are coupled to one another or to the input supply voltage without any additional interaction, e.g., from a user or other device.

In some examples, the switch circuit may couple the resistive elements of the heater elements in such a manner as to maintain approximately the same amount of power dissipation whether the input supply voltage is 110V AC or 220V AC. For example, the switch circuit includes a relay that may automatically couple one or more resistive elements of a first heater element and one or more resistive elements of a second heater element of the flexible heater in series between the input supply voltage lines when the input supply voltage is 220V AC. The relay, of the switch circuit, may automatically couple the one or more resistive elements of the first and second heater elements in parallel between the input supply voltage lines when the input supply voltage is 110V AC. In this manner, the heater elements may dissipate approximately the same amount of power whether the input supply voltage is 110V AC or 220V AC.

It may not be necessary, in every example, for the switch circuit to couple the one or more resistive elements of the heater elements in such a manner as to maintain approximately the same amount of power dissipation. In some alternate examples, the switch circuit may include a triode for alternating current (TRIAC) that allows the switch circuit to automatically couple the resistive elements of the first heater element and the resistive elements of the second heater element in parallel between the input supply voltage lines when the input supply voltage is 110V AC, as in the pervious example. However, in these alternate examples, when the input supply voltage is 220V AC, the switch circuit may couple the resistive elements of the first heater element to the input supply voltage lines, and the switch circuit may cause the TRIAC to not couple the resistive elements of the second heater element to the input supply voltage lines.

FIG. 1 is a block diagram illustrating an example flexible heater system 10. Flexible heater system 10 may include flexible heater 12, switch circuit 18, and socket 20. Although switch circuit 18 is illustrated as being external to flexible heater 12, in alternate examples, switch circuit 18 may be formed as a part of flexible heater 12.

Flexible heater 12 may comprise a device that conforms to the surface of an object and emanates heat to heat the object, or contents within the object. The object may be of any type and of any size. For example, the object may be a large cylindrical drum whose contents require heating. In this example, flexible heater 12 may be flexible to conform to the cylindrical surface. As another example, the object may be a component of a computer motherboard. In this example, flexible heater 12 may be flexible to conform to the surface of the component.

Flexible heater 12 may include flexible surface 14, and heater element 16A and 16B (collectively referred to as "heater elements 16"). Examples of flexible surface 14 include, but are not limited to, polyimide, silicone rubber, Mica, a foil, or other flexible surfaces. Heater elements 16 may each include one or more resistive elements formed on flexible surface 14. For example, heater elements 16 may be formed with copper, or other conductive elements, that are etched onto flexible surface 14.

Although FIG. 1 illustrates flexible heater 12 as including two heater elements 16, this disclosure is not limited to flexible heaters with two heater elements. In alternate examples, flexible heater 12 may include more than two heater elements 16, and techniques described in this disclosure are extendable to flexible heaters that include more than two heater elements 16. For purposes of illustration and ease of description, techniques described in this disclosure are described in the context of flexible heater 12 including two heater elements 16.

Socket 20 may deliver an input supply voltage to switch circuit 18 and flexible heater 12. For example, as illustrated, socket 20 is coupled to lines 22A-22C (collectively referred to as lines 22"). Line 22A is a power line, line 22B is a neutral line, and line 22C is a ground line. The ground line 22C may not be necessary in every example. Socket 20 may be a wall socket such as a power point, power socket, electric receptacle, plug socket, or electrical socket. The voltage delivered by socket 20 may be different for different geographic locations. For example, the voltage level of the voltage delivered by socket 20 in North America is approximately 110 volts alternating current, i.e., 110V AC. The voltage level of the voltage delivered by socket 20 in Europe is approximately 220V AC.

The voltage delivered by socket 20 causes a current to flow through the one or more resistive elements of heater elements 16. The flow of current through the resistive elements cause heater elements 16 to dissipate power, which in turn causes flexible heater 12 to emanate heat. The amount of dissipated power, which correlates to the amount of emanated heat, is a function of the input supply voltage level of the voltage from socket 20 and the collectively resistance of the resistive elements of heater elements 16. The amount of dissipated power (P) may be calculated by squaring the voltage from socket 20 and dividing the resulting value with the collective resistance of the resistive elements of heater elements 16. Because the amount of dissipated power is a function of the input supply voltage, heater elements 16 may dissipate different amounts of power for different input supply voltages levels. This may cause flexible heater 12 to emanate different amounts of heat.

In some examples, switch circuit 18 may automatically configure flexible heater 12 to emanate approximately the same amount of heat regardless of the input supply voltage level. For instance, in these examples, switch circuit 18 may cause heater elements 16 to dissipate approximately the same amount of power whether the input supply voltage level of the input supply voltage from socket 20 is 110V AC or 220V AC. To cause heater elements 16 to dissipate approximately the same amount of power, switch circuit 18 may automatically configure the coupling of the resistive elements of heater elements 16 to power line 22A and neutral line 22B based on the input supply voltage between power line 22A and neutral line 22B from socket 20. In other words, without any additional interaction from a user or another device, in these examples, switch circuit 18 couples one or more of the resistive elements of heater elements 16 to power line 22A and neutral line 22B such that heater elements 16 dissipate approximately the same amount of power whether the input supply voltage between lines 22A and neutral line 22B is 110V AC or 220V AC.

As one example, when the input supply voltage level of the input supply voltage between power line 22A and neutral line 22B is approximately 110V AC, switch circuit 18 may automatically couple the one or more resistive elements of heater element 16A to heater element 16B in a first configuration. In this first configuration, the resistive elements of heater element 16A may be in parallel with the resistive elements of heater element 16B. In this example, the current from socket 20 may flow through power line 22A and then split into two currents, where one current flows through the resistive elements of heater element 16A and another current flows through the resistive elements of heater element 16B. The two current may recombine into a single current, after flowing through heater elements 16, and flow through neutral line 22B to socket 20. In this example, the power dissipated by heater element 16A may be calculated as: resistance of heater element 16A*(110/((resistance of heater element 16A//resistance of heater element 16B)*2))$^2$. The symbol "//" indicates that the resistive elements of the heater elements 16A and 16B are in parallel. The resistance of the resistive elements of heater elements 16A and 16B in parallel may be calculated by summing the resistance values of the resistive elements of heater elements 16A and 16B, multiplying the resistance values of the resistive elements of heater elements 16A and 16B, and dividing the multiplied value with the summed value. The power dissipated by heater element 16B may be similarly calculated.

As another example, when the voltage between power line 22A and neutral line 22B is approximately 220V AC, switch circuit 18 may automatically couple the resistive elements of heater element 16A to the resistive elements of heater element 16B in a second configuration. In the second configuration the resistive elements of heater element 16A are in series with the resistive elements of heater element 16B. In this example, the current from socket 20 may flow through power line 22A, through the resistive elements of heater element 16A, then through the resistive elements of heater element 16B, and then through neutral line 22B to socket 20. In this example, the power dissipated by heater elements 16A may be calculated as: resistance of heater element 16A*(220/(resistance of heater element 16A plus resistance of heater element 16B))$^2$. The resistive elements of heater elements 16A and 16B may be in series, in this example. The power dissipated by heater element 16B may be similarly calculated.

In the above examples, if the resistances of the resistive elements of heater elements 16A and 16B are substantially similar, the power dissipated when socket 20 delivers 110V AC or 220V AC may be substantially similar. For example, assume that the resistance of the resistive elements of heater elements 16A and 16B is 50Ω. In this example, the parallel resistance of heater elements 16A and 16B is 25Ω. The power dissipated by heater elements 16A or 16B, when the input supply voltage is 110V AC, may be 50*(110$^2$/(25*2)$^2$), which is 242 Watts (W). Also, in this example, the series resistance of the resistive elements of heater elements 16A and 16B is 100Ω. The power dissipated by heater elements 16A or 16B, when the input supply voltage is 220V AC, may be 50*(220$^2$/100$^2$), which is also 242 W.

In the above examples, switch circuit 18 may automatically couple the resistive elements of heater elements 16 to lines 22A and 22B such that heater elements 16 dissipate substantially the same amount of power when the voltage level of the input supply voltage between lines 22A and 22B is 110V AC or 220V AC. However, aspects of this disclosure are not so limited. In some alternate examples, switch circuit 18 may automatically couple the one or more resistive elements of one or more heater elements 16 to lines 22A and 22B such that the power dissipated by heater elements 16, when the voltage level of the input supply voltage between lines 22A and 22B is 110V AC, is different than the power dissipated by heater elements 16 when the voltage level of the input supply voltage between lines 22A and 22B is 220V AC.

In these alternate examples, when the input supply voltage level is 110V AC, switch circuit 18 may automatically couple the resistive elements of heater element 16A to be in parallel with the resistive elements of heater element 16B, e.g., the first configuration, as in the previous example. However, in these alternate examples, when the input supply voltage level is 220V AC, switch circuit 18 may automatically couple the one or more resistive elements of heater element 16B such that the one or more resistive elements of heater element 16B are between lines 22A and 22B. In these alternate examples, switch circuit 18 may decouple the one or more resistive elements of heater element 16A from lines 22A and 22B. For example, switch circuit 18 may include a triode for alternating current (TRIAC). The TRIAC may couple the one or more resistive elements of heater elements 16A and 16B in parallel when the input supply voltage level is 110V AC. The TRIAC may couple the one or more resistive elements of heater element 16B between lines 22A and 22B, and may not couple the one or more resistive elements of heater element 16A, e.g., decouple heater element 16A, to lines 22A and 22B when the input supply voltage level is 220V AC.

When the input supply voltage level, e.g., the voltage level of the input supply voltage between lines 22A and 22B, is 220V AC, in these alternate examples, the current from socket 20 may flow through power line 22A, through the one or more resistive elements of heater element 16B, and then through neutral line 22B to socket 20. In this example, the power dissipated by heater elements 16 may be calculated as: 220$^2$/(resistance of heater element 16B). In this example, the collective resistance of heater elements 16 is the resistance of the one or more resistive elements of heater element 16B because heater element 16A is not coupled. In these alternate examples, when the input supply voltage level is 110V AC, the power dissipated by heater elements 16A may be calculated as: resistance of heater element 16A*(110/((resistance of heater element 16A//resistance of heater element 16B)*2))$^2$. The power dissipated by heater element 16B may be similarly calculated.

Assuming the resistance of the resistive elements of heater elements 16A and 16B is 50Ω, in these alternate examples, when the input supply voltage level is 110V AC, the power dissipated by heater elements 16A or 16B is 242 W, as in the previous example. However, in these alternate examples, when the input supply voltage level is 220V AC, the power dissipated by heater element 16B is 968 W, e.g., $220^2/50\Omega$, because heater element 16B is coupled between lines 22A and 22B, and heater element 16A is not coupled between lines 22A and 22B.

In the above examples, switch circuit 18 may couple all of the one or more resistive elements of heater elements 16A and 16B in parallel or in series, or may couple only the one or more resistive elements of heater element 16B between lines 22A or 22B. However, aspects of this disclosure are not so limited. In some alternate examples, as described in more detail below, switch circuit 18 may couple a select few resistive elements of the one or more resistive elements of heater elements 16A and 16B between lines 22A or 22B.

For instance, heater elements 16A and 16B may each include two resistive elements; although, it may be possible for heater elements 16A and 16B to include more than two resistive elements. In this example, a first resistive element of the two resistive elements of heater element 16A may be coupled to a relay or TRIAC. Similarly, a first resistive element of the two resistive elements of heater element 16B may be coupled to a relay or TRIAC.

In this example, the relay or TRIAC may selectively couple the first resistive element of heater elements 16A and 16B to the other resistive element of heater elements 16A and 16B, respectively, based on the input supply voltage such that the power dissipated by heater elements 16A and 16B is approximately the same whether the input supply voltage is 110V AC to 220V AC. As described in more detail with respect to FIGS. 7, 8, and 9, there may be different permutation and combinations of selectively coupling few of the resistive elements of heater elements 16A and 16B based on the input voltage level.

In some examples, flexible heater system 10 may optionally include additional components, not illustrated in FIG. 1, which may protect flexible heater 12 or an object placed on flexible heater 12 from damaging. For example, one or more of lines 22 may be coupled to one or more fuses. The one or more fuses may limit the amount of current that may flow on lines 22. Limiting the amount of current that may flow on lines 22 may protect heater elements 16 from damaging, and may limit the amount of heat emanating from flexible heater 12 to protect an object placed on flexible heater 12 from overheating. As another example, one or more lines 22 may be coupled to one or more thermostats. The one or more thermostats may measure the amount of heat emanating from flexible heater 12. If the amount of heat emanating from flexible heater 12 is greater than a predetermined threshold, the one or more thermostats may not allow any more current to flow through heater elements 16, causing flexible heater 12 to cool. In this manner, the one or more thermostats may protect an object placed on flexible heater 12 from overheating.

Figure 2:
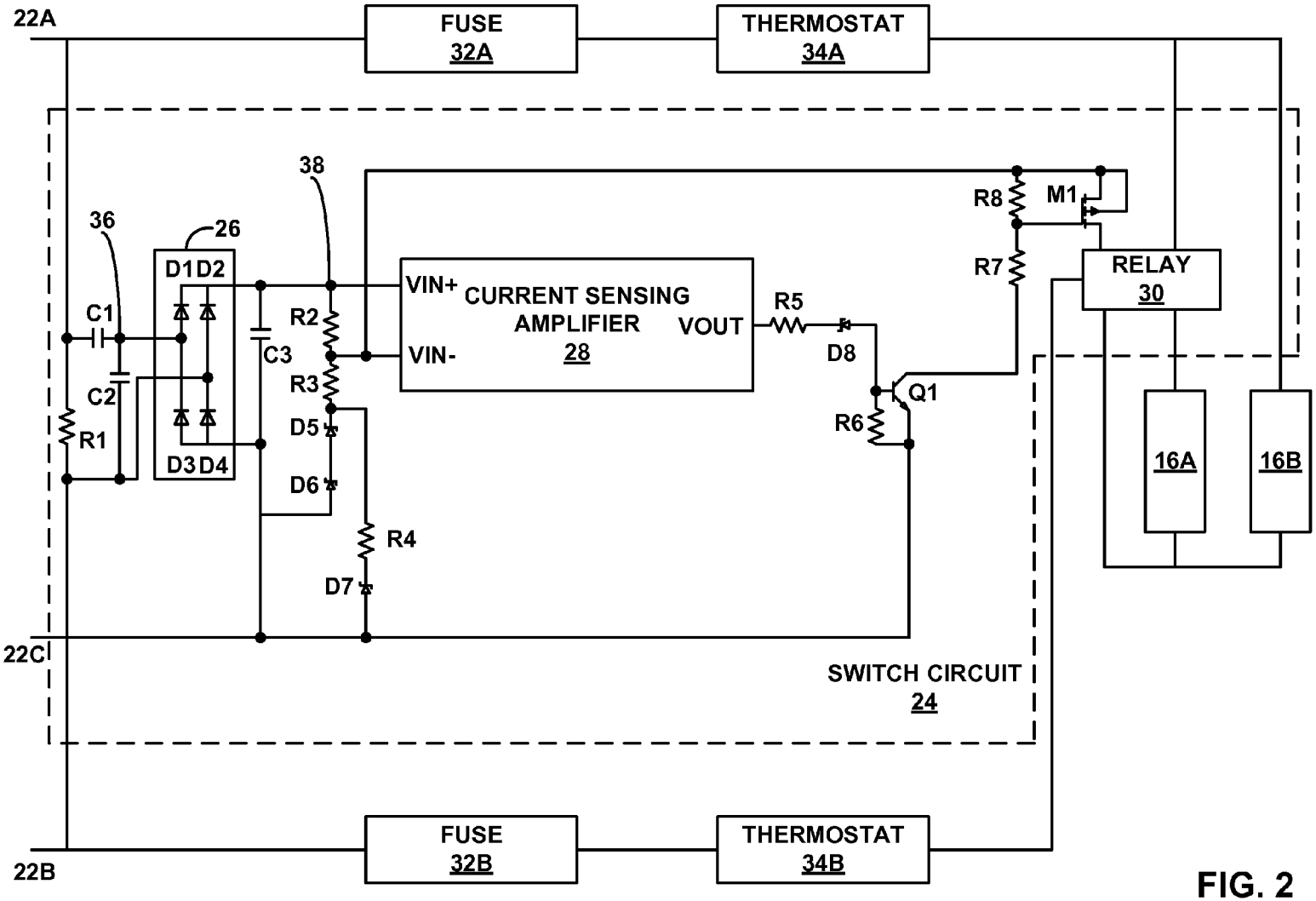
FIG. 2 is a block diagram illustrating an example switch circuit of FIG. 1 in greater detail.

FIG. 2 is a block diagram illustrating an example switch circuit of FIG. 1 in greater detail. For instance, FIG. 2 illustrates switch circuit 24 in dashed lines. Switch circuit 24 may be one example of switch circuit 18, and may be a current based switch circuit, as will be understood from the description below. The following description provides some example values of the components of switch circuit 24. However, it should be understood that the values of the components should not be considered limited to the example values provided below. Moreover, not all components illustrated in FIG. 2 may be necessary in every example of switch circuit 24. For example, diodes D5, D6, D7, and D8 may not be necessary in every example of switch circuit 24. In these examples, resistors R3 and R4 may be coupled directly to ground line 22C, and resistor R5 may be coupled directly to resistor R6 and transistor Q1.

As illustrated in FIG. 2, power line 22A and neutral line 22B are each coupled to fuses 36A and 36B, respectively, and thermostats 38A and 38B, respectively. Fuses 36A and 36B may limit the amount of current that flows to heater elements 16A and 16B, and thermostats 38A and 38B may limit the amount of heat emanating from flexible heater 12. For example, if the current through power line 22A and neutral 22B is greater than a predetermined threshold, fuses 36A and 36B may stop current from flowing through heater elements 16. As another example, if the heat emanating from flexible heater 12 is greater than a predetermined threshold, thermostats 38A and 38B may stop current from flowing through heater elements 16, which in turn causes flexible heater 12 to cool down. Fuses 36A and 36B and thermostats 38A and 38B may not be necessary in every example. Moreover, there may be more or fewer fuses and thermostats than illustrated in FIG. 2.

Switch circuit 24 may include resistor R1 coupled to power line 22A and neutral line 22B. Resistor R1 may define a resistance of approximately 100 kΩ and may protect a user of flexible heater 12 from a voltage shock if there is charge stored on the capacitors of switch circuit 28 after power line 22A and/or neutral line 22B are removed. Resistor R1 may not be necessary in every example. Resistor R1 may also couple to capacitors C1 and C2. Capacitor C1 may also be coupled to power line 22A, capacitor C2, and rectifier 26. Capacitor C2 may also be coupled to capacitor C1, neutral line 22B, and rectifier 26. Capacitor C1 may define a capacitance of approximately 0.47 micro-Farads (uF), and capacitor C2 may define a capacitance of approximately 1.5 uF. Capacitors C1 and C2 function as a step down voltage divider for the input supply voltage between lines 22A and 22B. Capacitors C1 and C2 may eliminate the use of a transformer to perform such step down functions. For example, when the input supply voltage level of the input supply voltage between power line 22A and neutral line 22B is approximately 110V AC, the voltage at node 36, which is between capacitors C1 and C2, may be approximately 27V AC. As another example, when the input supply voltage level is approximately 220V AC, the voltage at node 36 may be approximately 54 VAC when C3, R2, R3, D5, D6, D7 & R4 are not connected. Alternatively a transformer can also be used to step down AC voltage level.

The voltage at node 36 may be calculated as follows when 220V AC supply voltage is applied: 220*XC1/(XC1+XC2). The XC1 or XC2 may be considered as the capacitive impedance and may be calculated as 1/(2*pi*f*C1) or 1/(2*pi*PC2). Pi is approximately 3.142 and f is approximately 50 Hz, although f should not be limited to 50 Hz. In this example, voltage at node 36 may be approximately 54V AC when 220V AC is applied and voltage at node 36 may be approximately 27V AC when 110V AC is applied.

Switch circuit 24 may include rectifier 26. Rectifier 26 may convert the input supply voltage between lines 22A and 22B into a direct current (DC) voltage. As one example, as illustrated in FIG. 2, rectifier 26 is a full-wave rectifier that includes diodes D1-D4 arranged in a bridge configuration. As another example, rectifier 26 may comprise a half-wave rectifier. The output of rectifier 26 may include voltage ripples and capacitor C3 smoothes the voltage ripples to generate a DC voltage. Capacitor C3 may define a capacitance of approximately 220 uF. The voltage across capacitor C3, e.g., voltage at node 38, may be different for different input supply voltage levels. For example, when the input supply voltage level of the input supply voltage between lines 22A and 22B is 110V AC, the voltage at node 38 may be approximately 37 V DC when R2, R3, D5, D5, D7, and R4 are not connected. When the input supply voltage level of the input supply voltage between lines 22A and 22B is 220V AC, the voltage at node 38 may be approximately 75 V DC when R2, R3, D5, D7, and R4 are not connected. With the connection of R2, R3, D5, D6, D7, and R4, R2, R3, D5, D6, D7 and R4 maintain the voltage at node 38 to 27V DC when 220V AC is applied and to 24V DC when 110VAC is applied. Since voltage at the junction of D5 and R4 is made constant using D5 and D6 to 24V DC, current may flow through D5 and D6 if 220V AC will be applied, and current may not flow through D5 and D6 if 110VAC will be applied.

The voltage at node 38 causes a current to flow through resistors R2, R3, and R4 to ground line 22C. Resistor R2 may define a resistance of approximately 50Ω, resistor R3 may define a resistance of approximately 120Ω, and resistor R4 may define a resistance of approximately 4.7 kΩ. The current flowing through resistor R2 creates a voltage drop across resistor R2. The voltage drop across resistor R2 may be a function of the voltage at node 38. When the input supply voltage level of the input supply voltage between lines 22A and 22B is 220V AC, the voltage drop across resistor R2 may be greater than the voltage drop across resistor R2 when the input supply voltage level of the input supply voltage between lines 22A and 22B is 110V AC.

Switch circuit 24 may include current sensing amplifier 28. Current sensing amplifier 28 includes VIN+, VIN−, and VOUT nodes. The voltage at the VOUT node of current sensing amplifier 28 is based on the current through resistor R2. For instance, current sensing amplifier 28 outputs a voltage on the VOUT node based on the voltages at the VIN+ and VIN− nodes. As illustrated, VIN+ and VIN− nodes of current sensing amplifier 28 are each coupled to resistor R2. The voltages at the VIN+ and VIN− nodes, of current sensing amplifier 28, are based on the current that flows through resistor R2. One example of current sensing amplifier 28 is the LT1787 current sensing amplifier developed by Linear Technology. However, aspects of this disclosure should not be considered limited to the LT1787 current sensing amplifier. In some examples, when 110V AC is applied between lines 22A and 22B, VOUT, of current sensing amplifier 28, may be less than 3V DC. In these examples, when 220V AC is applied between lines 22A and 22B, VOUT, of current sensing amplifier 28, may be more than 5V DC.

The voltage at the VOUT node of current sensing amplifier 28 may determine whether transistor Q1 turns on or remains turned off. Transistor Q1 may be a bipolar junction transistor (BJT). When transistor Q1 is on, current flows from the collector terminal of transistor Q1 to the emitter terminal of transistor Q1. When transistor Q1 is off, current does not flow from the collector terminal of transistor Q1 to the emitter terminal of transistor Q1. Whether transistor Q1 turns on or remains turned off is based on the voltage at the base terminal of transistor Q1.

Resistors R5 and R6 may be coupled to the base terminal of transistor Q1. Resistor R5 may define a resistance of approximately 100Ω, and resistor R6 may define a resistance of approximately 10 kΩ. The voltage at the base terminal of transistor Q1 may be based on the voltage at the VOUT node of current sensing amplifier 28 and the voltage drop across resistor R6. In some examples, when the input supply voltage level is 110V AC, the voltage at the VOUT node of current sensing amplifier 28, e.g., when less than approximately 3V DC, may not be sufficient to turn on transistor Q1, e.g., transistor Q1 remains turned off. In these examples, when the input supply voltage level is 220V AC, the voltage at the VOUT node of current sensing amplifier 28, e.g., when more than approximately 5V DC, may be sufficient to turn on transistor Q1.

When transistor Q1 is off, current does not flow through resistor R7 via resistor R8. Resistor R7 may define a resistance of approximately 1 kΩ, and resistor R8 may define a resistance of approximately 33 kΩ. The lack of current through resistor R7 via resistor R8 causes transistor M1 to remain off. Transistor M1 may be a field effect transistor (FET). When transistor M1 is off, relay 30 may remain off. As described in more detail, when relay 30 is off, relay 30 may couple the one or more resistive elements of heater element 16A and heater element 16B in a first configuration. The first configuration may include the resistive elements of heater element 16A and heater element 16B being coupled in parallel with one another. As described above, transistor Q1 is off when the input supply voltage level is 110V AC, which in turn causes transistor M1 to remain off, which in turn causes relay 30 to remain off. In the example of FIG. 2, when the input supply voltage level is 110V AC, relay 30 remains off, which in turn causes relay 30 to automatically couple the resistive elements of heater element 16A and 16B in parallel with one another.

When transistor Q1 is on, current flows through resistor R7 via resistor R8. The flow of current through resistor R7 via resistor R8 causes transistor M1 to turn on. When transistor M1 is on, relay 30 may turn on. As described in more detail, when relay 30 is on, relay 30 may couple the resistive elements of heater element 16A and heater element 16B in a second configuration. The second configuration may include the resistive elements of heater element 16A and heater element 16B being in series with one another. As described above, transistor Q1 is on when the input supply voltage level is 220V AC, which in turn causes transistor M1 to turn on, which in turn causes relay 30 to turn on. In the example of FIG. 2, when the input supply voltage level is 220V AC, relay 30 turns on, which in turn causes relay 30 to automatically couple the resistive elements of heater element 16A and 16B in series with one another.

When relay 30 automatically couples the resistive elements of heater elements 16A and 16B in parallel with one another, the collective resistance of heater elements 16A and 16B may be calculated by summing the resistance of the resistive elements of heater elements 16A and 16B, multiplying the resistance of the resistive elements of heater elements 16A and 16B, and dividing the multiplied value with the summed value. For example, if the resistance of the resistive elements of heater elements 16A and 16B is each 100Ω, the collective resistance of heater elements 16A and 16B when heater elements 16A and 16B are in parallel with one another is 50Ω.

When relay 30 automatically couples heater elements 16A and 16B in series with one another, the collective resistance of heater elements 16A and 16B may be calculated by summing the resistances of the resistive elements of heater elements 16A and 16B. For instance, keeping with the previous example resistance values, the collective resistance of the resistive elements of heater elements 16A and 16B when heater elements 16A and 16B are in series with one another is 200Ω.

As described above, the power dissipated by heater element 16A when the resistive elements of heater elements 16A and 16B are in parallel with one another may be calculated as: resistance of heater element 16A*((input supply voltage)/((resistance of heater element 16A//resistance of heater element 16B)*2))$^2$. The power dissipated by heater element 16B may be calculated in a substantially similar manner. In this example, when the input supply voltage is 110V AC, the power dissipated by heater element 16A or heater element 16B is 100*(110$^2$/(50*2)$^2$) which equals 121 W. In other words, in this example, when the input supply voltage is 110V AC, each one of heater elements 16A and 16B dissipate approximately 121 W.

As described above, the power dissipated by heater element 16A when the resistive elements of heater elements 16A and 16B are in series with one another may be calculated as: resistance of heater element 16A*((input supply voltage)/(resistance of heater element 16A plus resistance of heater element 16B))$^2$. The power dissipated by heater element 16B may be calculated in a substantially similar manner. In this example, when the input supply voltage is 220V AC, the power dissipated by heater element 16A or heater element 16B is 100*(220$^2$/200$^2$) which equals 121 W. In other words, in this example, when the input supply voltage is 220V AC, each one of heater elements 16A and 16B dissipate approximately 121 W. Accordingly, in this example, the power dissipated by heater element 16A or heater element 16B is approximately the same whether the input supply voltage is 110V AC or 220V AC, e.g., the power dissipated is approximately 121 W when the supply voltage is 110V AC or 220V AC.

Figure 3A:
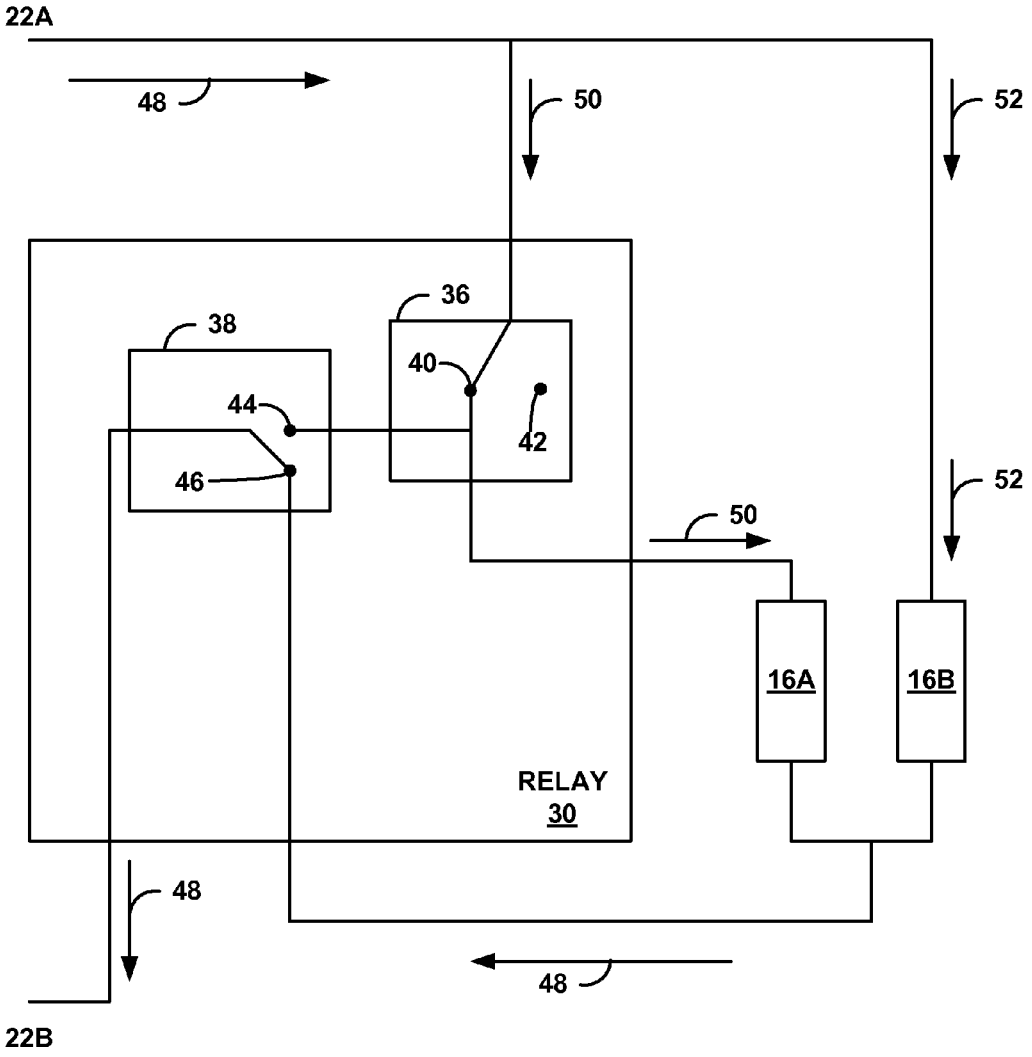
FIG. 3A is a block diagram illustrating an example of a relay, of the switch circuit of FIG. 2, when the relay is in an off configuration.
Figure 3B:
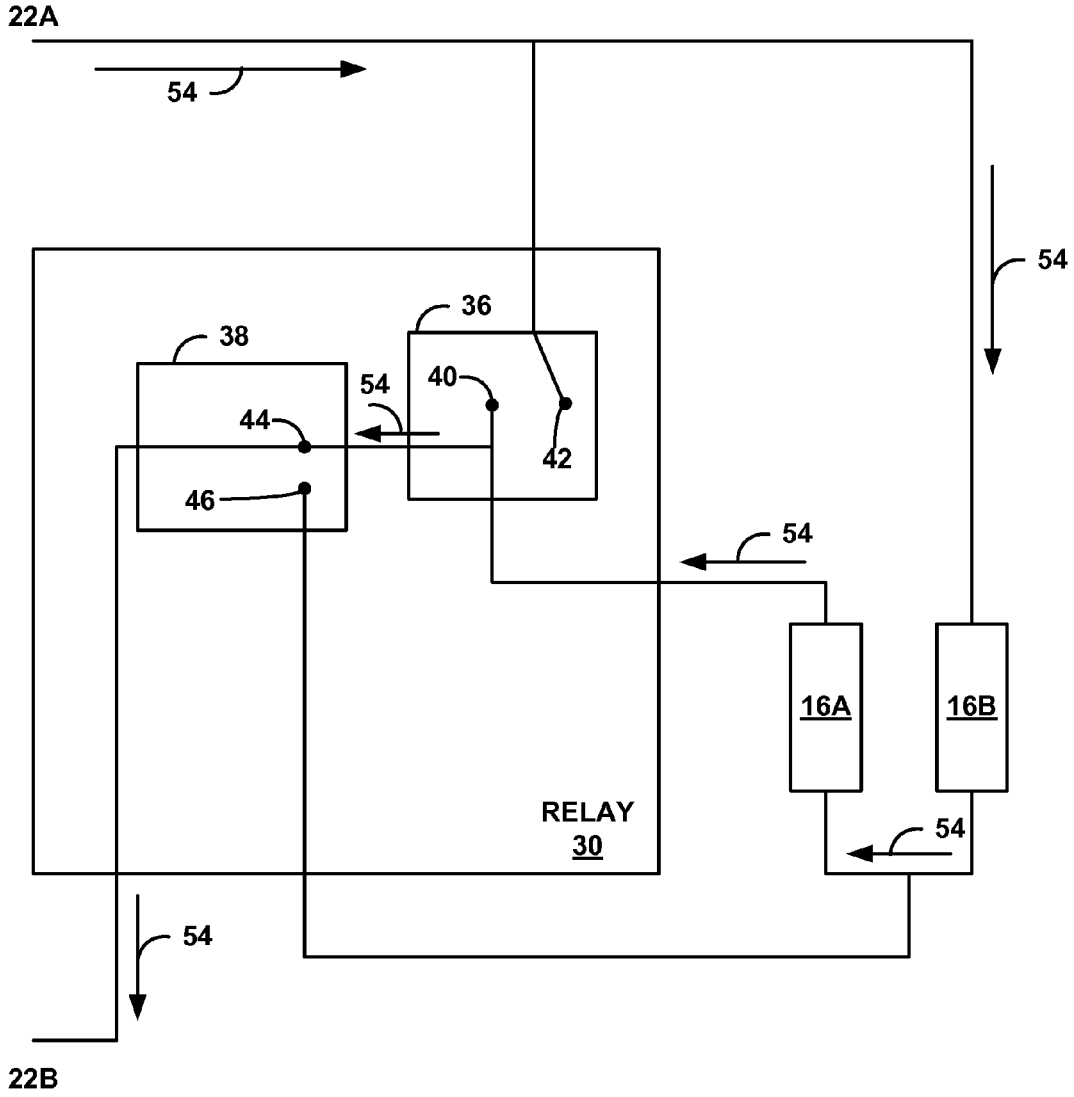
FIG. 3B is a block diagram illustrating an example of the relay, of the switch circuit of FIG. 2, when the relay is in an on configuration.

FIG. 3A is a block diagram illustrating an example of relay 30, of switch circuit 24, when relay 30 is in the off configuration. FIG. 3B is a block diagram illustrating an example of relay 30, of switch circuit 24, when relay 30 is in the on configuration. As described above, relay 30 may turn on when transistor M1 turns on, and relay 30 may remain off when transistor M1 remains off. Relay 30 may be a double pole double throw (DPDT) electro-mechanical relay, as one example, although aspects of this disclosure should not be considered limited to a DPDT electro-mechanical relay. Relay 30 may include a plurality of switches such as switch 36 and switch 38. Switch 36 may include node 40 and node 42. Node 40 may be coupled to the resistive elements of heater element 16A, and node 42 is an open node, e.g., not connected to any component. Switch 38 may include node 44 and node 46. Node 44 of switch 38 may be coupled to node 40 of switch 36. Node 46 may be coupled to the resistive elements of both heater elements 16A and 16B.

As illustrated in FIG. 3A, when relay 30 is in the off configuration, relay 30 may configure switch 36 to couple the one or more resistive elements of heater element 16A to power line 22A via node 40. When relay 30 is in the off configuration, relay 30 may configure switch 38 to couple the one or more resistive elements of heater elements 16A and 16B to neutral line 22B via node 46. In this configuration, the resistive elements of heater element 16A and 16B may be in parallel with one another. For example, the resistive elements of heater elements 16A and 16B are both coupled to power line 22A and neutral line 22B. For instance, the resistive elements of heater element 16A is coupled to power line 22A via switch 36, and the resistive elements of heater element 16B is directly coupled to power line 22A. The resistive elements of heater elements 16A and 16B are also coupled to neutral line 22B via switch 38.

In some examples, relay 30 is normally in the off configuration until turned on by transistor M1. In these examples, node 40 may be considered as normally closed (NC), and node 42 may be considered as normally open (NO) because switch 36 normally couples node 40 to line 22 and not to node 42. Also, in these examples, node 46 may be considered as NC, and node 44 may be considered as NO because switch 38 normally couples node 46 to line 22B and not to node 44.

In the example of FIG. 3A, power line 22A may carry current 48 from socket 20. Current 48 may split into current 50 and current 52. Current 50 may flow through the one or more resistive elements of heater element 16A via switch 36, and current 52 may flow through the one or more resistive elements of heater element 16B. After flowing through the one or more resistive elements of heater elements 16A and 16B, currents 50 and 52 may recombine into current 48. Current 48 may flow to neutral line 22B via switch 38, and then back to socket 20.

As illustrated in FIG. 3B, when relay 30 is in the on configuration, relay 30 may configure switch 36 and switch 38 to couple the one or more resistive elements of heater element 16A to neutral line 22B via node 40 of switch 36 and node 44 of switch 38. In this configuration, the one or more resistive elements of heater element 16A and 16B may be in series with one another. For example, the one or more resistive elements of heater element 16B are directly coupled to power line 22A, and the one or more resistive elements of heater element 16A are not coupled to power line 22A. The one or more resistive elements of heater element 16B are coupled to the one or more resistive elements of heater element 16A. The one or more resistive elements of heater element 16A is coupled to neutral line 22B via switch 36 and switch 38, and the one or more resistive elements of heater element 16B is not coupled to neutral line 22B.

In the example of FIG. 3B, power line 22A may carry current 54 from socket 20. Current 54 may be substantially similar to current 48 (FIG. 3A). Current 54 may flow through the resistive elements of heater element 16B, and through the resistive elements of heater element 16A. After flowing through the resistive elements of heater element 16A, current 54 may flow through switch 36, through switch 38, then through neutral line 22B, and back to socket 20.

Figure 4:
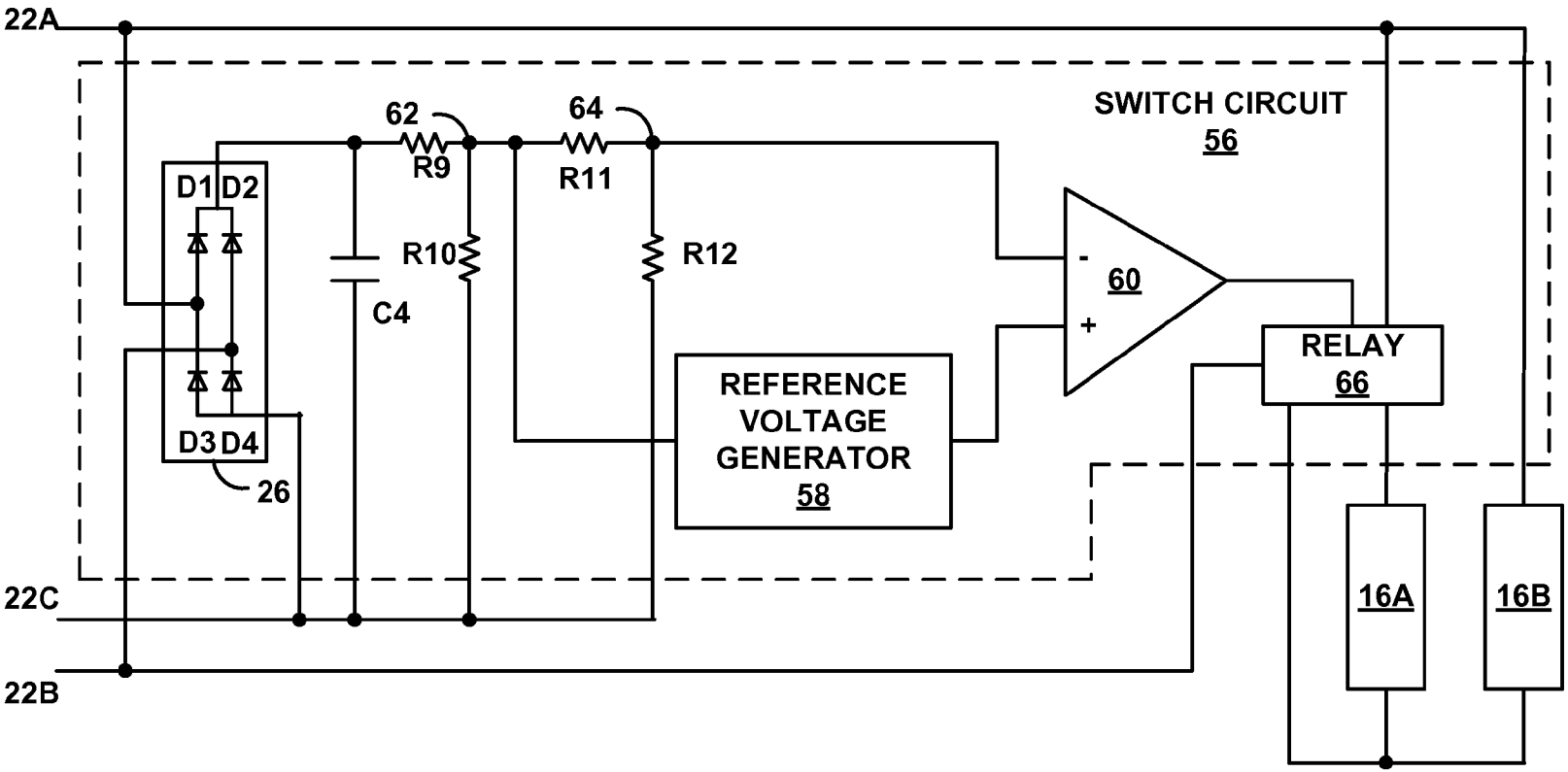
FIG. 4 is a block diagram illustrating another example switch circuit of FIG. 1 in greater detail.

FIG. 4 is a block diagram illustrating another example switch circuit. For instance, FIG. 4 illustrates switch circuit 56 in dashed lines. Switch circuit 56 may be one example of switch circuit 18, and may be a voltage based switch circuit, as will be understood from the description below. Similar to FIG. 3, the following description provides some example values of the components of switch circuit 56. However, it should be understood that the values of the components should not be considered limited to the example values provided below. Moreover, for purposes of clarity, fuses 32A and 32B and thermostats 34A and 34B, both of FIG. 2, are not shown in FIG. 4. It should be understood that the example illustrated in FIG. 4 may include fuses and thermostats similar to fuses 32A and 32B and thermostats 34A and 34B.

Switch circuit 56 may include rectifier 26 coupled to power line 22A and neutral line 22B. Rectifier 26 may be substantially similar to rectifier 26 of FIG. 2. For example, rectifier 26 may comprise a full-wave or half-wave rectifier for conversion of the input supply voltage between lines 22A and 22B into a DC voltage. Similar to the example of FIG. 2, the output of rectifier 26 may include voltage ripples and capacitor C4 smoothes the voltage ripples to generate a DC voltage. Capacitor C4 may define a capacitance of approximately 220 uF.

Capacitor C4 is coupled to a voltage divider that includes resistors R9 and R10. For example, capacitor C4 is coupled to resistor R9, which is coupled to resistor R10. Resistor R10 is coupled to ground line 22C. Resistor R9 is coupled to another voltage divider that includes resistors R11 and R12. For example, resistor R9 is coupled to resistor R11, which is coupled to resistor R12. Resistor R12 is coupled to ground line 22C.

The voltage across capacitor C4, e.g., the voltage at node 62, and the voltage across resistor R12, e.g., the voltage at node 64, may be different for different voltage levels. Moreover, the voltage at node 62 and node 64 may be a function of the resistance of resistors R9, R10, R11, and R12. For example, assume that the resistance of resistors R9, R10, R11, and R12 define a resistance of 610 kΩ 10 kΩ, 10 kΩ and 2.5 kΩ respectively. In this example, when the input supply voltage level of the input supply voltage between lines 22A and 22B is 110V AC, the voltage at node 62 is approximately 2.5V, and the voltage at node 64 is approximately 1V. Also, in this example, when the input supply voltage level is 220V AC, the voltage at node 62 is approximately 5V, and the voltage at node 64 is approximately 2V.

Switch circuit 56 may also include reference voltage generator 58. Resistor R9 may also be coupled to reference voltage generator 58. Reference voltage generator 58 may generate a voltage from the voltage at node 62. The voltage at node 64 may be greater than the voltage generated by reference voltage generator 58 when the input supply voltage is 220V AC, and may be less than the voltage generated by reference voltage generator 58 when the input supply voltage is 110V AC In some examples, the voltage generated by reference voltage generator 58 may be approximately the average of the voltage at node 64 when the input supply voltage level of the input supply voltage is 220V AC and the voltage at node 64 when the input supply voltage level of the input supply voltage is 110V AC. For instance, the voltage generated by reference voltage generator 58 may be approximately 1.5V because, in the example of FIG. 4, the voltage at node 64 is 2V when the input supply voltage level of the input supply voltage between lines 22A and 22B is 220V AC and the voltage at node 64 is 1V when the input supply voltage level of the input supply voltage between lines 22A and 22B is 110V AC.

Comparator 60 may receive the voltage generated by reference voltage generator 58 and the voltage at node 64. As one example, comparator 60 may be an operation amplifier comparator. Comparator 60 may compare the voltages from reference voltage generator 58 and node 64, and output a voltage based on the comparison. For example, if the voltage generated by reference voltage generator 58 is less than the voltage at node 64, comparator 60 may output a voltage that turns on relay 66. If the voltage generated by reference voltage generator 58 is greater than the voltage at node 64, comparator 60 may output a voltage that keeps relay 66 turned off.

For instance, in the example of FIG. 4, the voltage generated by reference voltage generator 58 is 1.5V. As described above, the voltage at node 64 is 2V when the input supply voltage between lines 22A and 22B is 220V AC, and 1V when the input supply voltage between lines 22A and 22B is 110V AC. In this example, comparator 60 may output a voltage to turn on relay 66 when the input supply voltage between lines 22A and 22B is 220V AC, and may output a voltage that keeps relay 66 turned off when the input supply voltage between lines 22A and 22B is 110V AC.

Relay 66 may be substantially similar to relay 30 of FIG. 2. However, in the example of FIG. 4, comparator 60 may turn on relay 66 or keep relay 66 turned off. Relay 66 may be considered as a zero crossing detector or driver. For example, similar to relay 30, when relay 66 is in the off configuration, the switches within relay 66 may automatically couple the one or more resistive elements of heater elements 16A and 16B to be in parallel with one another, e.g., the first configuration, as illustrated in FIG. 3A. As another example, similar to relay 30, when relay 66 is in the on configuration, the switches within relay 66 may automatically couple the one or more resistive elements of heater elements 16A and 16B to be in series with one another, e.g., the second configuration, as illustrated in FIG. 3B.

Similar to switch circuit 24 of FIG. 2, switch circuit 56 may automatically couple the one or more resistive elements of heater elements 16A and 16B such that the power dissipated by heater elements 16A and 16B is substantially the same whether the input supply voltage between lines 22A and 22B is 110V AC or 220V AC, e.g., whether the input supply voltage level is 110V AC or 220V AC. For example, when the input supply voltage between lines 22A and 22B is 110V AC, comparator 60 may keep relay 66 turned off so that relay 66 automatically couples the one or more resistive elements of heater elements 16A and 16B in parallel with one another. When the input supply voltage between lines 22A and 22B is 220V AC, comparator 60 may turn on relay 66 so that relay 66 automatically couples the one or more resistive elements of heater elements 16A and 16B in series with one another. As described above, when the resistive elements of heater elements 16A and 16B are in parallel with one another, and the input supply voltage level is 110V AC, the power dissipated by heater elements 16A and 16B may be substantially the same as when the resistive elements of heater elements 16A and 16B are in series with one another, and the input supply voltage level is 220V AC.

Figure 5:
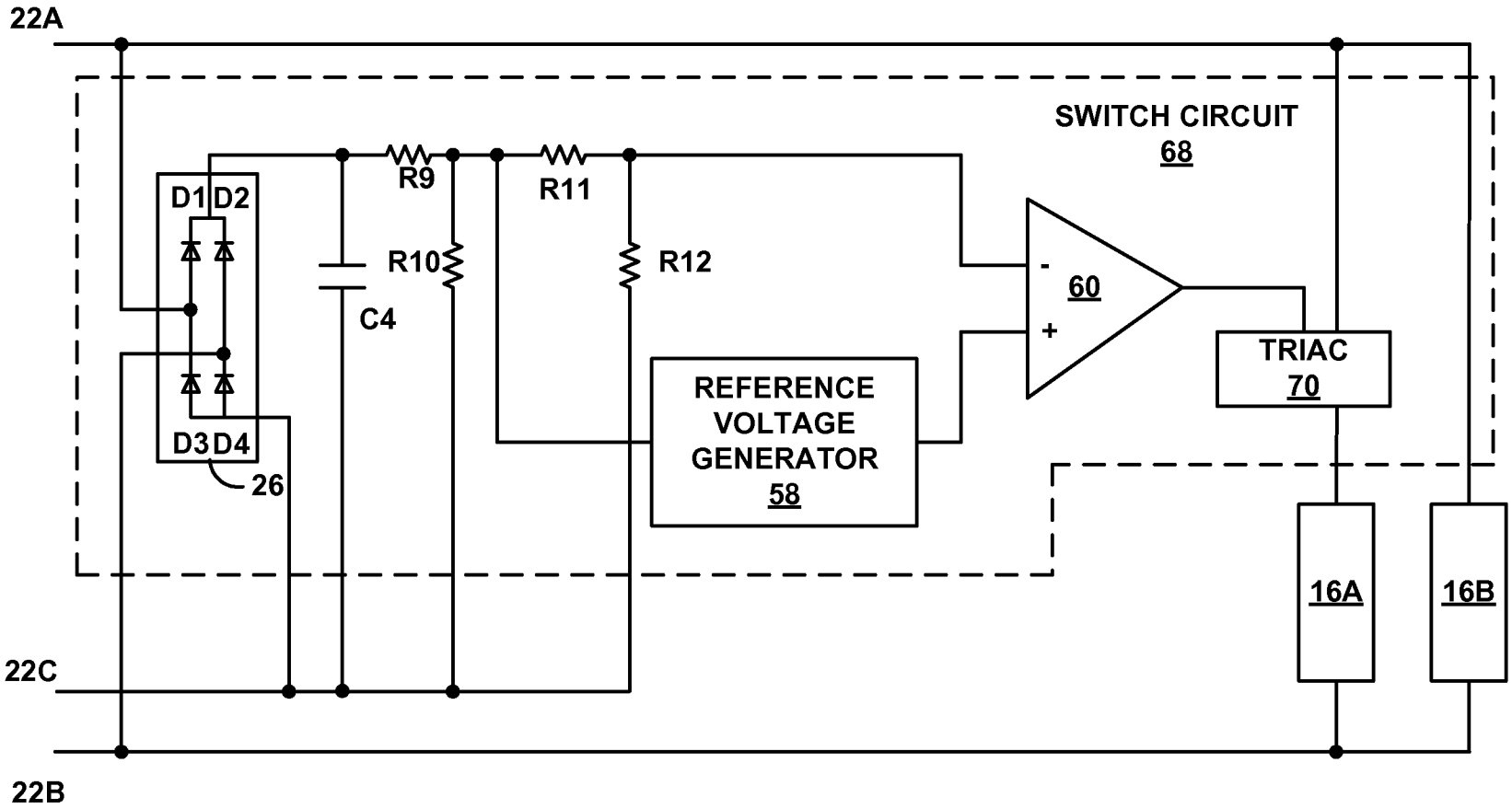
FIG. 5 is a block diagram illustrating another example switch circuit of FIG. 1 in greater detail.

FIG. 5 is a block diagram illustrating another example switch circuit. For instance, FIG. 5 illustrates switch circuit 68 in dashed lines. Switch circuit 68 may be one example of switch circuit 18, and may be a voltage based switch circuit, as will be understood from the description below. For purposes of clarity, fuses 32A and 32B and thermostats 34A and 34B, both of FIG. 2, are not shown in FIG. 5. It should be understood that the example illustrated in FIG. 5 may include fuses and thermostats similar to fuses 32A and 32B and thermostats 34A and 34B.

Switch circuit 68 may include similar components as switch circuit 56 of FIG. 4. For example, similar to switch circuit 54, switch circuit 68 may include rectifier 26, capacitor C4, resistors R9, R10, R11, R12, reference voltage generator 58, and comparator 60. These components may perform similar functions as described above with respect to FIG. 4.

Switch circuit 68 may include triode for alternating current (TRIAC) 70. TRIAC 70 may automatically and selectively couple the resistive elements of heater element 16A to power line 22A based on the input supply voltage between lines 22A and 22B. For example, when the input supply voltage level is 110V AC, the output voltage from comparator 60 may cause TRIAC 70 to not couple the resistive elements of heater element 16A to power line 22A. When the input supply voltage level is 220V AC, the output voltage from comparator 60 may cause TRIAC 70 to couple the resistive elements of heater element 16A to power line 22A. In the example of FIG. 5, switch circuit 68 may always couple the resistive elements of heater element 16B to power line 22A.

In the example of FIG. 5, when the input supply voltage level is 110V AC, switch circuit 68 may automatically couple the resistive elements of heater elements 16A and 16B in parallel with one another. In this configuration, the collective resistance of heater elements 16A and 16B may be the resistance of heater elements 16A and 16B when in parallel, as described above. The power dissipated by heater elements 16A and 16B, in the example of FIG. 5, may be substantially the same as the power dissipated by heater elements 16A and 16B, in the examples of FIGS. 2 and 4, when the input supply voltage level is 110V AC.

When the input supply voltage level is 220V AC, switch circuit 68 may automatically couple the resistive elements of heater element 16B to lines 22A and 22B, and not couple the resistive elements of heater element 16A to power line 22A. In this configuration, the collective resistance of heater elements 16A and 16B may be the resistance of heater element 16B. In the example of FIG. 5, the power dissipated by heater elements 16A and 16B when the input supply voltage level is 220V AC may be calculated by squaring 220 and dividing the resulting value with the resistance of heater element 16B.

In the example of FIG. 5, the power dissipated by heater elements 16A and 16B when the voltage level is 110V AC may be different than the power dissipated by heater elements 16A and 16B when the input supply voltage level is 220V AC. For example, assume that the resistance of the one or more resistive elements of each of heater elements 22A and 22B is 100Ω. In this example, when the input supply voltage level is 110V AC, the power dissipated by heater element 16A or heater element 16B is approximately 121 W, e.g., $100*(110^2/(50*2)^2)$. When the input supply voltage level is 220V AC, the power dissipated by heater elements 16 is approximately 484 W, e.g., $220^2/100$, which is approximately four times the power dissipated by either heater element 16A or heater element 16B when the input supply voltage level is 110V AC.

Figure 6:
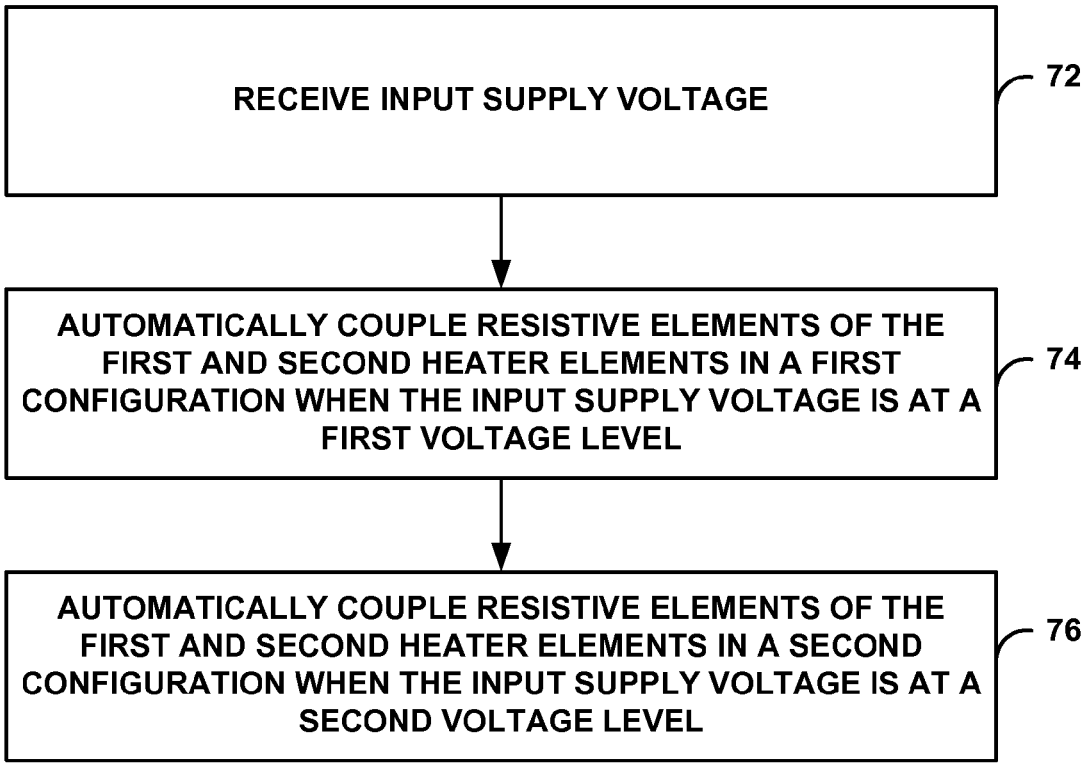
FIG. 6 is a flowchart illustrating an example operation of the flexible heater system.

FIG. 6 is a flowchart illustrating an example operation of a flexible heater system. For purposes of illustration, reference is made to FIGS. 1, 2, 4, and 5. Switch circuit 18, of flexible heater system 10, may receive an input supply voltage from socket 20, of flexible heater system 10 (72). Examples of switch circuit 18 include switch circuit 24, of FIG. 2, switch circuit 56, of FIG. 4, and switch circuit 68, of FIG. 5. Switch circuit 18 may receive the input supply voltage from socket 20 via lines 22.

Switch circuit 18 may automatically couple one or more resistive elements of a first heater element and a second heater element formed on flexible heater 12 in a first configuration when the input supply voltage is at a first voltage level (74). For example, the first and the second heater elements may be heater element 16B and heater element 16A, respectively, of flexible heater 12. The first voltage level may be approximately 110V AC. As one example of the first configuration, switch circuit 18 may couple the resistive elements of heater element 16A and heater element 16B in parallel with one another. For example, relay 30, of FIG. 2, relay 66, of FIG. 4, and TRIAC 70, of FIG. 5, may automatically couple the resistive elements of heater elements 16A and 16B in parallel with one another when the input supply voltage level is 110V AC.

Switch circuit 18 may automatically couple the resistive elements of the first heater element and the second heater element formed on flexible heater 12 in a second configuration when the input supply voltage is at a second voltage level (76). The second voltage level may be approximately 220V AC. As one example of the second configuration, switch circuit 18 may couple the resistive elements of heater element 16A and heater element 16B in series with one another. For example, relay 30, of FIG. 2, and relay 66, of FIG. 4, may automatically couple the resistive elements of heater elements 16A and 16B in parallel with one another when the input supply voltage level is 220V AC. As another example of the second configuration, switch circuit 18 may couple the resistive elements of heater element 16B to power line 22A, and not couple the resistive elements of heater element 16A to power line 22A. For example, TRIAC 70, of FIG. 5, may automatically couple the resistive elements of heater element 16B to power line 22A when the input supply voltage level is 220V AC, and may not couple the resistive elements of heater element 16A to power line 22A when the input supply voltage level is 220V AC.

As described above, switch circuit 24 of FIG. 2, switch circuit 56 of FIG. 4, and switch circuit 68 of FIG. 5 selectively couple all of the one or more resistive elements of heater elements 16A and 16B in different configurations, e.g., a first or second configuration, based on the input supply voltage. In some examples, a switch circuit similar to switch circuit 24 of FIG. 2, switch circuit 56 of FIG. 4, and switch circuit 68 of FIG. 5 may selectively couple a few of the one or more resistive elements of heater elements 16A and 16B in different configurations based on the input supply voltage.

Figure 7:
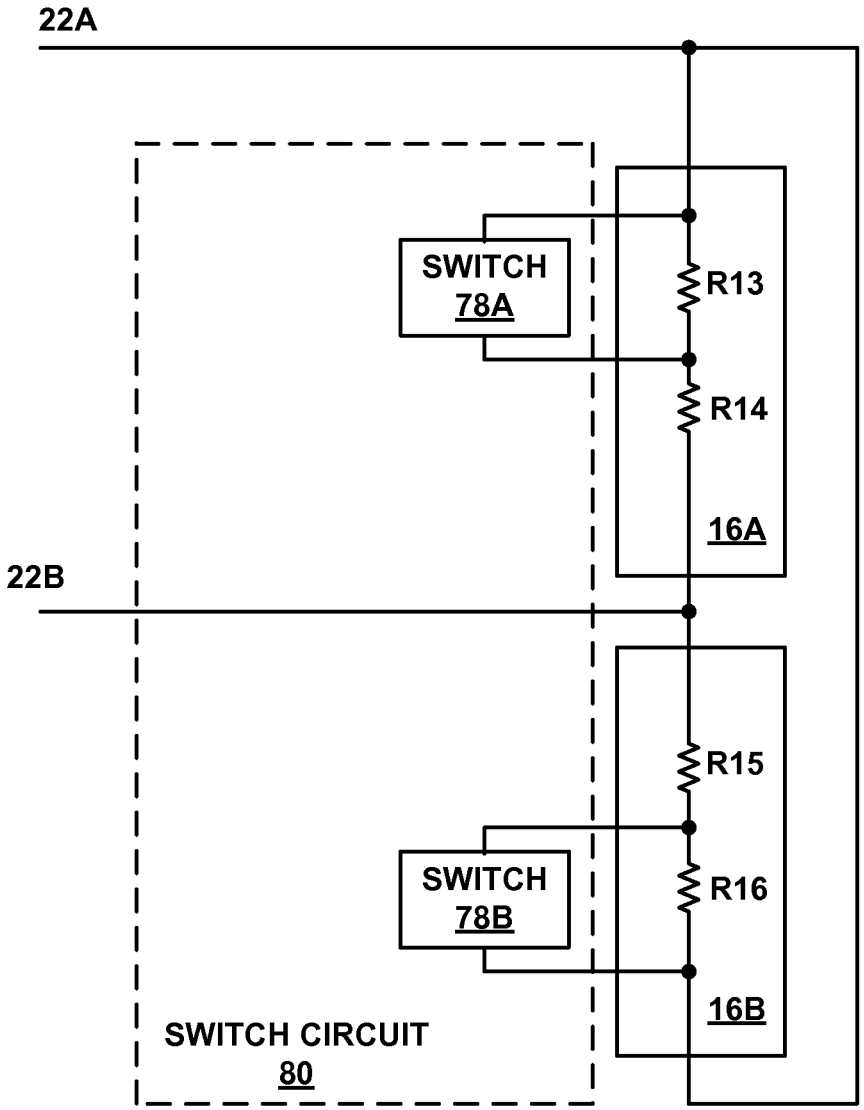
FIG. 7 is a block diagram illustrating another example switch circuit of FIG. 1 in greater detail.

FIG. 7 is a block diagram illustrating another example switch circuit. For instance, FIG. 7 illustrates switch circuit 80 in dashed lines. Switch circuit 80 may be one example of switch circuit 18, and may be a voltage or current based switch circuit, as will be understood from the description below. For purposes of clarity, fuses 32A and 32B and thermostats 34A and 34B, both of FIG. 2, are not shown in FIG. 7. It should be understood that the example illustrated in FIG. 7 may include fuses and thermostats similar to fuses 32A and 32B and thermostats 34A and 34B.

As illustrated in FIG. 7, switch circuit 80 may include switch 78A and switch 78B (collectively referred to as "switches 78"). In some examples, rather than two switches 78, switch 78A may be formed within switch 78B to form a single switch. Switches 78 may be substantially similar to relay 30 of FIG. 2, relay 66 of FIG. 4, or TRIAC 70 of FIG. 5. For example, similar to relay 30 of FIG. 2, switches 78 may turn on or off based on the voltage of transistor M1 of FIG. 2. Similarly, like relay 66 of FIG. 4 or TRIAC 70 of FIG. 5, switches 78 may turn on or off based on the output of comparator 60 of FIGS. 4 and 5. It should be noted that switches 78 should not be considered limited to relays or TRIACs and may be any type of switches.

In the example of FIG. 7, heater element 16A includes resistive element R13 and R14, and heater element 16B includes resistive element R15 and R16. Switch circuit 80 may selectively turn on or off switches 78 based on the input supply voltage such that heater elements 16A and 16B dissipate approximately the same amount of power whether the input supply voltage is 110V AC or 220V AC.

As illustrated in FIG. 7, switches 78 may be coupled in parallel with resistive element R13 and R16, respectively. When switch circuit 80 turns on switches 78, the resistive elements of heater elements 16A and 16B may be in a first configuration. For example, when switch circuit 80 turns on switches 78, switches 78 may be closed and may essentially create a short across resistive elements R13 and R16 such that little to no current can flow through resistive elements R13 and R16. When switch circuit 80 turns off switches 78, switches 78 may be opened, and the resistive elements of heater elements 16A and 16B may be in a second configuration. For example, when switch circuit 80 turns off switches 78, switches 78 may be opened and current can flow through resistive elements R13 and R16.

As one example, assume that resistive elements R13, R14, R15, and R16 define a resistance of 120Ω, 30Ω, 50Ω, and 100Ω, respectively. In this example, when the input supply voltage is 220V AC, switch circuit 80 may turn off switches 78 such that switches 78 are open. In this instance, the collective resistance of resistive elements R13, R14, R15, and R16 may be 75Ω, e.g., (120Ω+30Ω)*(100Ω+50)/(120Ω+

30Ω+100Ω+50Ω). The power dissipated by heater elements 16 may be calculated as: $(220^2)/75\Omega$ which is approximately 645.33 W.

In this example, when the input supply voltage is 110V AC, switch circuit 80 may turn on switches 78 such that switches 78 are closed. In this instance, the collective resistance of resistive elements R13, R14, R15, and R16 may be 18.75Ω, e.g., (30Ω)*(50Ω)/(30Ω+50Ω), because resistive elements R13 and R16 are shorted by switches 78. The power dissipated by heater elements 16 may be calculated as: $(110^2)/18.75\Omega$ which is approximately 645.33 W. Accordingly, in the example of FIG. 7, heater elements 16A and 16B dissipate approximately the same amount of power whether the input supply voltage is 110VAC or 220V AC.

Figure 8:
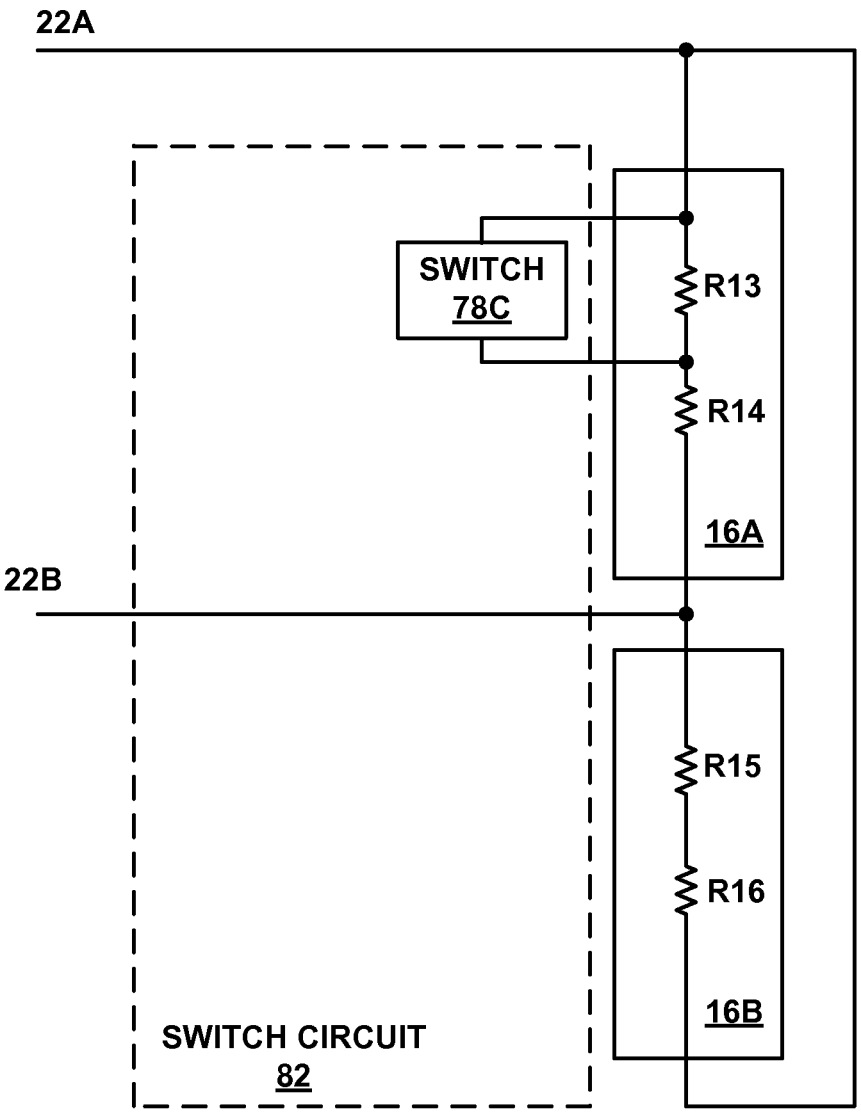
FIG. 8 is a block diagram illustrating another example switch circuit of FIG. 1 in greater detail.

In the example of FIG. 7, both heater elements 16 are coupled to one of switches 78. However, aspects of this disclosure are not so limited. FIG. 8 is a block diagram illustrating another example switch circuit. For instance, FIG. 8 illustrates switch circuit 82 in dashed lines. Switch circuit 82 may be one example of switch circuit 18, and may be a voltage or current based switch circuit, as will be understood from the description below. For purposes of clarity, fuses 32A and 32B and thermostats 34A and 34B, both of FIG. 2, are not shown in FIG. 8. It should be understood that the example illustrated in FIG. 8 may include fuses and thermostats similar to fuses 32A and 32B and thermostats 34A and 34B.

Switch circuit 82 of FIG. 8 may be substantially similar to switch circuit 80 of FIG. 7. However, in the example of FIG. 8, switch circuit 82 includes only one switch, e.g., switch 78C. Switch 78C may be substantially similar to switches 78A and 78B of FIG. 7. For example, similar to relay 30 of FIG. 2, switch 78C may turn on or off based on the voltage of transistor M1 of FIG. 2. Similarly, like relay 66 of FIG. 4 or TRIAC 70 of FIG. 5, switch 78C may turn on or off based on the output of comparator 60 of FIGS. 4 and 5.

In the example of FIG. 8, switch 78C may be coupled in parallel with resistive element R13 of heater element 16A. Similar to the example of FIG. 7, in the example of FIG. 8, switch circuit 82 may selectively turn on or off switch 78C based on the input supply voltage such that heater elements 16A and 16B dissipate approximately the same amount of power whether the input supply voltage is 110V AC or 220V AC. When switch circuit 82 turns on switch 78C, the resistive elements of heater elements 16A and 16B may be in a first configuration. For example, when switch circuit 80 turns on switch 78C, switch 78C may be closed and may essentially create a short across resistive element R13 such that little to no current can flow through resistive element R13. When switch circuit 82 turns off switch 78C, switch 78C may be opened, and the resistive elements of heater element 16A may be in a second configuration. For example, when switch circuit 82 turns off switch 78C, switch 78C may be opened and current can flow through resistive element R13.

In the examples of FIGS. 7 and 8, a select few of the resistive elements of heater elements 16A and 16B are coupled to switches, e.g., switches 78A and 78B of FIG. 7, and switch 78C of FIG. 8. However, aspects of this disclosure are not so limited. In some examples, one or more of the resistive elements of heater elements 16A and 16B may be coupled to switches similar to switches 78A, 78B, and 78C.

Figure 9:
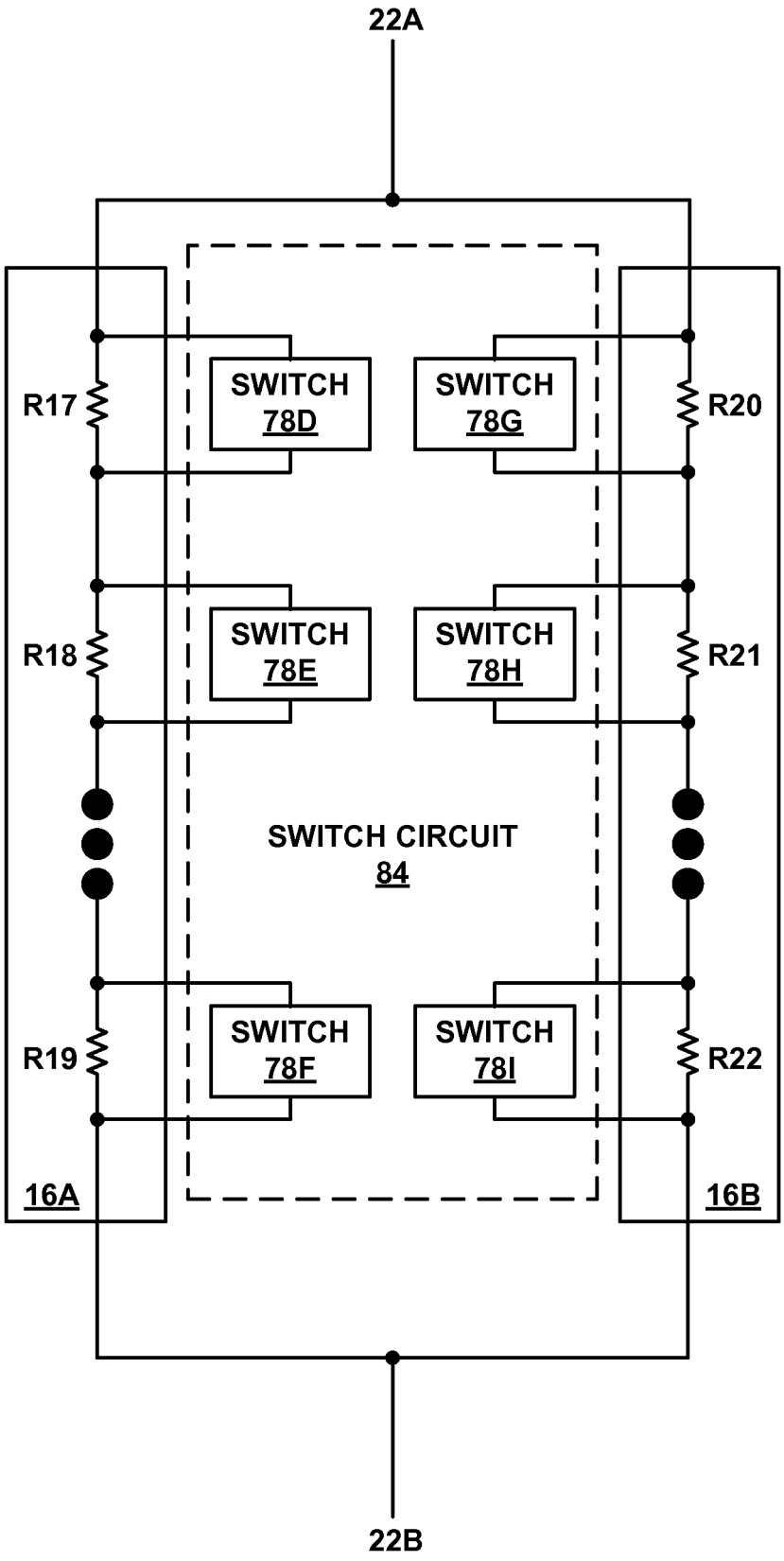
FIG. 9 is a block diagram illustrating another example switch circuit of FIG. 1 in greater detail.

FIG. 9 is a block diagram illustrating another example switch circuit. For instance, FIG. 9 illustrates switch circuit 84 in dashed lines. Switch circuit 84 may be one example of switch circuit 18, and may be a voltage or current based switch circuit, as will be understood from the description below. For purposes of clarity, fuses 32A and 32B and thermostats 34A and 34B, both of FIG. 2, are not shown in FIG. 9. It should be understood that the example illustrated in FIG. 9 may include fuses and thermostats similar to fuses 32A and 32B and thermostats 34A and 34B.

As illustrated in FIG. 9, switch circuit 84 includes switches 78D-78I. Switches 78D-78I may be substantially similar to switches 78A and 78B of FIG. 7 and switch 78C of FIG. 8. For example, similar to relay 30 of FIG. 2, switches 78D-78I may turn on or off based on the voltage of transistor M1 of FIG. 2. Similarly, like relay 66 of FIG. 4 or TRIAC 70 of FIG. 5, switches 78D-78I may turn on or off based on the output of comparator 60 of FIGS. 4 and 5.

In this example, each one of the switches 78D-78I is coupled in parallel to respective resistive elements R17-R22. In the example of FIG. 9, switch circuit 84 may selectively turn on or off one or more of switches 78D-78I such that little to no current can flow through one or more of resistive elements R17-R22, or such that current can flow through one or more resistive elements R17-R22. For example, switch circuit 84 may selectively turn on or off one or more of switches 78D-78I based on the input supply voltage. In some examples, switch circuit 84 may selectively turn on or off one or more of switches 78D-78I such that the power dissipated by heater elements 16A and 16B is approximately the same whether the input supply voltage is 110V AC or 220V AC.

Various aspects of the disclosure have been described. These and other aspects are within the scope of the following claims.

The invention claimed is:

1. A flexible heater system comprising:

a first input-power terminal;

a second input-power terminal, the first input-power terminal and the second input-power terminal configured to be electrically connected to an AC input-supply voltage;

a first heater supply terminal electrically coupled to the first input-power terminal through a first supply network;

a second heater supply terminal electrically coupled to the second input-power terminal through a second supply network;

a flexible heater that includes a first heater element that includes one or more resistive elements and a second heater element that includes one or more resistive elements, the first heater element having a first resistance approximately equal to a second resistance of the second heater element;

at least one switch having a 110 Volt mode and a 220 Volt mode, when in the 110 Volt mode, the at least one switch connects the first and second heater elements in a parallel fashion to the first and second heater supply terminals, and when in the 220 Volt mode, the at least one switch connects the first and second heater elements in a serial fashion to the first and second heater supply terminals; and a switch circuit having an AC/DC converter having input terminals connected to the first and second input-power terminals, the AC/DC converter generating a DC output signal proportional to the magnitude of the AC input-supply voltage, the switch circuit also having a resistor/diode network configured to establish a predetermined DC voltage threshold corresponding to a predetermined AC voltage between 110 Volts and 220 Volts, wherein if the DC output signal is greater than the predetermined DC voltage threshold then the switch circuit puts the at least one switch in the 220 Volt mode, and if the DC output signal is less than the predetermined DC voltage threshold, then the switch circuit puts the at least one switch in the 110 Volt mode, so that a power dissipated by the first heater element and the second heater element is approximately equal when the AC input-supply voltage is at 110 Volts or 220 Volts.

2. The flexible heater system of claim 1, wherein the at least one switch comprises a double pole relay.

3. The flexible heater system of claim 1, wherein the at least one switch comprises a triode for alternating current (TRIAC).

4. The flexible heater system of claim 1, further comprising a socket that delivers the input supply voltage to the first and second input-power terminals.

5. The flexible heater system of claim 1, wherein the first supply network includes a fuse.

6. The flexible heater system of claim 1, wherein the first supply network includes a thermostat.

* * * * *